United States Patent [19]

Rosenberg

[11] 4,261,296

[45] Apr. 14, 1981

[54] ANIMAL RESTRAINT

[76] Inventor: Alexander J. Rosenberg, 1000 Edge Hill Rd., Roslyn, Pa. 19001

[21] Appl. No.: 58,834

[22] Filed: Jul. 18, 1979

Related U.S. Application Data

[63] Continuation-in-part of Ser. No. 820,125, Jul. 29, 1977, Pat. No. 4,170,961.

[51] Int. Cl.[3] ..... A61D 3/00

[52] U.S. Cl. ..... 119/103

[58] Field of Search ..... 119/103, 109, 120; 248/244, 245, 295 A; 177/154, 225; 211/94, 94.5, 162, 207

[56] References Cited

U.S. PATENT DOCUMENTS

| | | | |
|---|---|---|---|
| 1,404,173 | 1/1922 | Barnard | 119/103 |
| 3,120,836 | 2/1964 | Brauning | 119/103 |
| 3,208,432 | 9/1965 | Fisk | 119/103 |
| 3,266,464 | 8/1966 | Davis | 119/103 |
| 3,330,258 | 7/1967 | Rosenberg | 119/103 |
| 3,554,477 | 1/1971 | D'Altrui | 248/245 |
| 4,170,961 | 10/1979 | Rosenberg et al. | 119/103 |

FOREIGN PATENT DOCUMENTS

| | | | |
|---|---|---|---|
| 791726 | 12/1935 | France | 248/245 |

*Primary Examiner*—Gene Mancene
*Assistant Examiner*—Robert P. Swiatek
*Attorney, Agent, or Firm*—Weiser, Stapler & Spivak

[57] ABSTRACT

An adjustable restraint is provided within a track to permit vertical height adjustment to accommodate the device to the size of the animal being restrained. The slide includes an upper cleat and a lower hook suitable for rope cinching purposes. A clamp is associated with the hook to releasably lock the slide in a desired vertical position upon the track.

5 Claims, 2 Drawing Figures

ANIMAL RESTRAINT

RELATED APPLICATION

This application is a continuation-in-part of application Ser. No. 820,125 filed July 29, 1977 and now U.S. Pat. No. 4,170,961.

BACKGROUND OF THE INVENTION

The invention relates generally to an adjustable height restraint suitable for securing small animals upon an examination platform.

Veterinary examining tables of the elevating type have been developed to lift animals, such as cats and dogs, from the floor to examining height without physical exertion and without danger to the veterinarian. Suitable restraints have been employed to make the examination of any size animal easier, quicker, safer and more humane.

As illustrated in Rosenberg U.S. Pat. No. 3,330,258 and Rosenberg application Ser. No. 820,125, filed July 29, 1977, now U.S. Pat. No. 4,170,961, it is known to provide adjustable restraints which are useful to secure an animal to the examination table in a manner to prevent injury to both the animal and the veterinarian. While the restraint devices previously utilized have generally proved to be satisfactory, it has been found that the examination of the animal could be hampered by the relatively free nature of the restraint vertical slide movement. Especially in case of an injured animal or in cases wherein it was desirable or necessary to simultaneously treat either both front paws or both rear paws, the former restraint devices have proved deficient.

SUMMARY OF THE INVENTION

The present invention relates generally to animal restraints, and more particularly, is directed to a vertically adjustable restraint including a locking mechanism suitable to secure the restraint in a selected height adjusted position.

The restraint of the present invention is particularly adaptable for use with veterinary examination tables and comprises generally a vertically oriented track, a slide that is vertically movable along the track and a locking mechanism suitable to secure the slide in a desired vertical position upon the track. In a preferred embodiment, the slide includes an upper cleat for rope securing purposes and a lower hook or keeper of suitable size and design to receive a restraint rope. The cleat is spaced from the hook a sufficient distance to assure that the veterinarian or other worker will not be bitten or otherwise injured during the animal securing and rope cinching operations.

The restraint normally vertically slides upon its associated track and once the animal restraining rope is tied to the hook and to the cleat, the slide will automatically ride upon its track to a natural and comfortable height, depending upon the height of the animal being restrained. Once the optimum elevation is reached by the slide, that is, the most comfortable position for the animal, the locking mechanism can be activated to thereby secure the slide in the most desirable position prior to commencement of the treatment of the animal.

It is therefore an object of the present invention to provide an improved animal restraint device of the type set forth.

It is another object of the present invention to provide a novel veterinary table restraint that is vertically adjustable and lockable to accommodate the varying height of animals to be treated.

It is another object of the present invention to provide a novel veterinary table restraint including means to lock the restraint in a preselected vertically adjusted position.

It is another object of the present invention to provide a novel veterinary table restraint which is capable of being automatically adjusted to a desirable height and of being locked in a preselected vertical position to support an animal in either a standing or lying position for examination and treatment purposes.

It is another object of the present invention to provide a novel veterinary table restraint that is simple in design, rugged in construction and trouble free when in use.

Other objects and a fuller understanding of the invention will be had by referring to the following description and claims of a preferred embodiment thereof, taken in conjunction with the accompanying drawings, wherein like reference characters refer to similar parts throughout the several views and in which:

DESCRIPTION OF THE PREFERRED EMBODIMENT OF THE INVENTION

Figure 1:
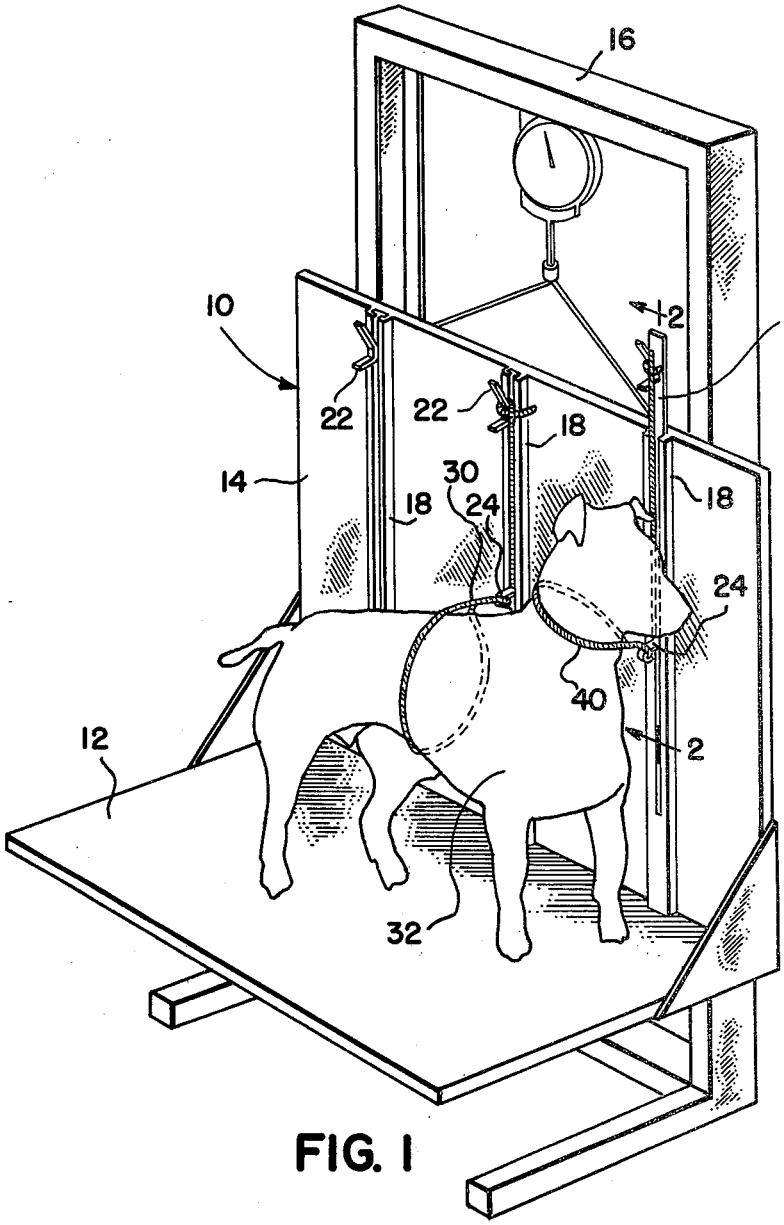
FIG. 1 is a perspective view of the restraint of the present invention in use in conjunction with a veterinary examination table.

Although specific terms are used in the following description for the sake of clarity, these terms are intended to refer only to the particular structure of the invention selected for illustration in the drawings and are not intended to define or limit the scope of the invention.

Referring now to the drawings, there is illustrated in FIG. 1 a veterinary examining table 10 which comprises generally a horizontal platform 12 and a vertical back support 14 which is rearwardly joined to and rises above the top surface of the platform 12. The vertical back support 14 is equipped with a plurality of spaced, vertical tracks 18 within which a vertical restraint slide 20 is respectively vertically movable. Accordingly, as an animal 32 is placed upon the platform 12 and is restrained to a slide 20 by utilizing a conventional restraint rope 30, the slide 20 will automatically adjust within the track 18 to the most comfortable height for the animal being restrained. In accordance with the said U.S. Pat. No. 3,330,258 and the pending application Ser. No. 820,125, the platform 12 and the attached back support 14 are vertically adjustable in height relative to the supporting frame 16 by a power mechanism (not shown) suitable to elevate the platform.

Figure 2:
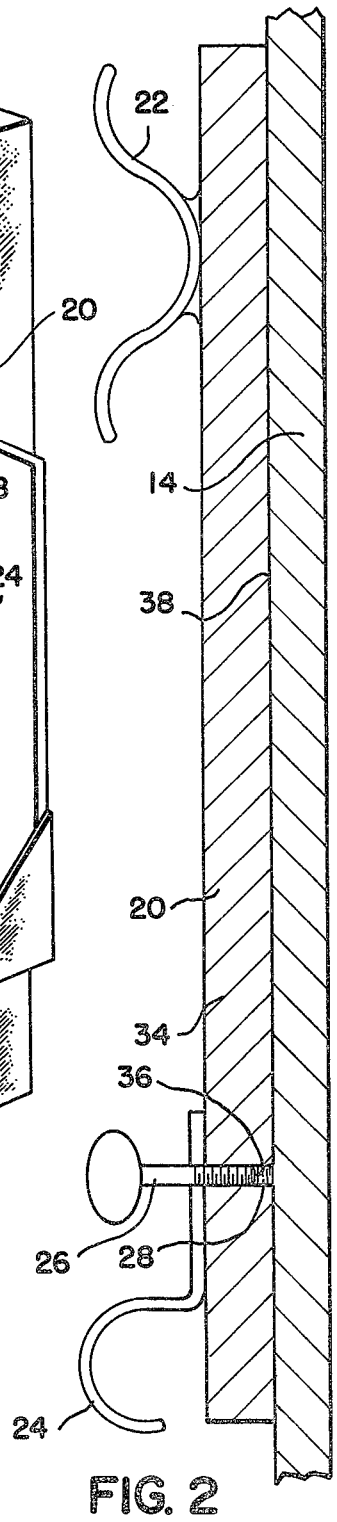
FIG. 2 is an enlarged, side elevational view of the restraint slide.

Each restraint slide 20 is a vertical, sliding fit within its associated vertical track 18 and comprises a cleat means such as an upper cleat 22 and a hook means such as a lower hook 24 which is vertically spaced below the cleat. A lock means comprising a movable member which may be a thumbscrew 26 is adjustable within the threaded opening 28 to provide a simple, easily workable, restraint locking means. As illustrated in FIG. 2, the threaded opening 28 extends completely through the restraint slide body 34 whereby the back support 14 is exposed through the opening 28. Accordingly, by turning the thumbscrew 26 within the threaded opening 28, the forward nose 36 of the thumbscrew can be made to engage upon the adjacent surface 38 of the back support 14 to thereby lock the restraint 20 in a desired vertical position within its associated track 18.

In order to use the restraint of the present invention, the veterinarian (not shown) first loops one or more restraint ropes 30, 40 about a portion of the animal 32, for example, its neck or body. The free end of the rope is passed through the eye of the hook 24, to thus draw the animal tightly against the restraint slide 20 by pulling on the free end to thereby urge the animal towards the slide. When the animal has been urged sufficiently into the vicinity of the slide 20, the free end can then be secured to the cleat 22. It will be noted that the restraint slide 20 will rise upwardly within its associated track 18 so that the hook 24 rises to an elevation roughly equivalent to the height of that portion of the animal 32 being secured. The vertical spacing of the cleat 22 above the hook 24, will be sufficient to assure that the veterinarian will not be bitten during the rope cinching operation.

When an animal 32 is cinched to the restraint slide 20 by utilizing a restraint rope 30 or 40, the restraint slide 20 will naturally ride upwardly within its associated track 18 and will adjust itself to the height most comfortable to the animal. The restraint slide 20 will naturally adjust vertically in accordance with the position of that part of the animal secured to a restraint slide 20. Accordingly, larger animals will raise the restraint slide 20 higher than smaller animals, but all animals will be just as comfortably restrained. Once the restraint slide or slides 20 have been utilized to secure the portions of the animal 32 as desired and the restraint slides 20 have risen within their respective tracks 18 to the comfortable height, then the thumbscrew 26 can be threadedly turned within the threaded opening 28 to press the thumbscrew forward end 36 against the adjacent face 38 of the back support 14, thereby locking the restraint slide 20 in the most desirable position.

Although the invention has been described with a certain degree of particularly, it is understood that the present disclosure has been made only by way of example and that numerous changes in the details of construction and the combination and arrangements of parts may be restored to without departing from the spirit and scope of the invention as hereafter claimed.

What is claimed is:

1. In an animal restraint operable by a veterinarian and suitable to comfortably restrain an animal of the type comprising a horizontal platform, a vertical back support and means to vertically move the platform and back support, the improvement comprising a vertical track secured to the back support and adapted to vertically move when the back support is vertically moved;

a restraint slide vertically movable relative to the track, the restraint slide comprising a body, hook means affixed to the body to receive an animal securing rope therein and a cleat means affixed to the body to secure the rope thereto, the hook means and the cleat means being vertically spaced a suitable distance to prevent the animal from reaching the cleat means when the rope is received in the hook means; and lock means operable through the restraint body to lock the restraint slide in a desired vertical position upon the track, the lock means being spaced from the cleat means a sufficient distance to permit operation of the lock means by the veterinarian without being bitten by the restrained animal.

2. The restraint of claim 1 wherein the restraint body comprises a top end and a bottom end and wherein the cleat means is affixed near the top end and the hook means is affixed near the bottom end.

3. The restraint of claims 1 or 2 wherein the lock means is positioned at the hook means.

4. The method of restraining by a rope an animal upon an examination table of the type including a horizontal platform, a rearwardly affixed vertical back support, a vertical track carried by the back support and a slide including a hook and a cleat in spaced relationship and being vertically movable within the track, comprising the steps of looping a first end of the rope about a portion of the animal and securing the first end to prevent disengagement of the said portion;

passing the second end of the rope through the hook and drawing the portion of the animal tightly against the slide by pulling on the second end;

vertically moving the slide to an elevated position within the track to elevate the hook to an elevation roughly equivalent to the height of that portion of the animal that is being secured;

tying the second rope end to the cleat and securing the restrained portion of the animal to the slide; and locking the slide to the track in its said elevated position and restraining the portion of the animal in elevated relation to the horizontal platform.

5. The method of claim 4 wherein the animal has a mouth capable of biting and wherein the locking is accomplished without being bitten.

* * * * *